US011053450B2

(12) United States Patent
Khelidj et al.

(10) Patent No.: US 11,053,450 B2
(45) Date of Patent: Jul. 6, 2021

(54) ALKYL CAPPED OIL SOLUBLE POLYMER VISCOSITY INDEX IMPROVING ADDITIVES FOR BASE OILS IN AUTOMOTIVE APPLICATIONS

(71) Applicants: Dow Global Technologies LLC, Midland, MI (US); Total Marketing Services, Puteaux (FR)

(72) Inventors: Nadjet Khelidj, Zurich (CH); Martin R. Greaves, Baar (CH)

( * ) Notice: Subject to any disclaimer, the term of this patent is extended or adjusted under 35 U.S.C. 154(b) by 0 days.

(21) Appl. No.: 15/328,160

(22) PCT Filed: Jul. 23, 2015

(86) PCT No.: PCT/US2015/041688

§ 371 (c)(1),
(2) Date: Jan. 23, 2017

(87) PCT Pub. No.: WO2016/018708

PCT Pub. Date: Feb. 4, 2016

(65) Prior Publication Data

US 2017/0211010 A1 Jul. 27, 2017

Related U.S. Application Data

(60) Provisional application No. 62/031,197, filed on Jul. 31, 2014.

(51) Int. Cl.

| | |
|---|---|
| ***C10M 145/34*** | (2006.01) |
| ***C10M 111/04*** | (2006.01) |
| ***C10M 101/02*** | (2006.01) |
| ***C10M 105/04*** | (2006.01) |
| *C10N 30/02* | (2006.01) |
| *C10N 40/04* | (2006.01) |
| *C10N 40/25* | (2006.01) |

(52) U.S. Cl.

CPC ..... *C10M 145/34* (2013.01); *C10M 101/02* (2013.01); *C10M 105/04* (2013.01); *C10M 111/04* (2013.01); *C10M 2203/003* (2013.01); *C10M 2203/024* (2013.01); *C10M 2203/1006* (2013.01); *C10M 2203/1025* (2013.01); *C10M 2205/0285* (2013.01); *C10M 2209/084* (2013.01); *C10M 2209/107* (2013.01); *C10M 2209/1065* (2013.01); *C10M 2209/1085* (2013.01); *C10N 2030/02* (2013.01); *C10N 2040/04* (2013.01); *C10N 2040/25* (2013.01)

(58) Field of Classification Search

CPC ..... C10M 2203/024; C10M 2203/003; C10M 2209/107; C10N 2230/02; C10N 2240/10; C10N 2020/02; C10N 2040/25

See application file for complete search history.

(56) References Cited

U.S. PATENT DOCUMENTS

| | | | | |
|---|---|---|---|---|
| 2,717,242 | A | 9/1955 | Foehr | |
| 2010/0004151 | A1* | 1/2010 | Bush | C10M 107/34 508/564 |
| 2014/0018273 | A1* | 1/2014 | Zweifel | C10M 107/34 508/545 |
| 2014/0274843 | A1* | 9/2014 | Tindall | C08F 210/14 508/465 |

FOREIGN PATENT DOCUMENTS

| | | | |
|---|---|---|---|
| EP | 0549253 | A1 | 6/1993 |
| JP | S4837402 | A | 6/1973 |
| JP | S4840803 | A | 6/1973 |
| JP | 2007204451 | | 8/2007 |
| WO | WO-0029522 | A1 | 5/2000 |
| WO | 2012134794 | | 10/2012 |
| WO | WO-2014066076 | A1 | 5/2014 |

OTHER PUBLICATIONS

International Search Report & Written Opinion for related PCT Application PCT/US2015/041688, dated Oct. 8, 2015 (51 pgs).
2nd Written Opinion for related PCT Application PCT/US2015/041688, dated Oct. 24, 2016 (5 pgs).
International Preliminary Report on Patentability for related PCT Application PCT/US2015/041688, dated Dec. 16, 2016 (9 pgs).
Office Action dated Mar. 5, 2019 by the Japanese Patent Office for corresponding Japanese Application No. 2017-504780.

* cited by examiner

*Primary Examiner* — Vishal V Vasisth
(74) *Attorney, Agent, or Firm* — Harness, Dickey & Pierce, PLC

(57) ABSTRACT

An automotive lubricant base oil formulation contains a base oil, preferably a hydrocarbon base oil, having a kinematic viscosity of 100 centiStokes or less at 40 degrees Celsius and an ailcyl capped oil soluble polymer where the alkyl capped oil soluble polymer has the structure of Formula 0): where $R^1$ is an alkyl having from one to thirty carbons, $R^2$ and $R^3$ are independently selected from alkyl groups having three or four carbons and can be in block form or randomly combined, $R^4$ is an alkyl having from one to 18 carbon atoms, n and m are independently numbers ranging from zero to 20 provided that n+m is greater than zero and p is a number within a range of one to three and a kinematic viscosity of 100 centiStokes or less at 40 degrees Celsius is useful in a lubricant for mechanical devices.

$$R^1[O(R^2O)_n(R^3O)_mR^4]_p \quad (I)$$

8 Claims, No Drawings

ALKYL CAPPED OIL SOLUBLE POLYMER VISCOSITY INDEX IMPROVING ADDITIVES FOR BASE OILS IN AUTOMOTIVE APPLICATIONS

CROSS-REFERENCE TO RELATED APPLICATION

This application is a National Stage Application under 35 U.S.C. § 371 of International Application Number PCT/US2015/041688, filed Jul. 23, 2015 and published as WO 2016/018708 on Feb. 4, 2016, which claims the benefit to U.S. Provisional Application 62/031,197, filed Jul. 31, 2014, the entire contents of which are incorporated herein by reference in its entirety.

BACKGROUND OF THE INVENTION

Field of the Invention

The present invention relates to base oil formulations for use in automotive lubricant formulations, the base oil formulation comprising a base oil and an alkyl capped oil soluble polymer, use of such a base oil formulation in an automotive lubricant formulation, and a method for improving the viscosity index and low temperature viscosity of a base oil suitable for use in automotive applications.

Introduction

Mechanical devices use lubricants in order to reduce wear of parts that move proximate to one another. One such mechanical device is an internal combustion engine with pistons that move within cylinders and that are lubricated with engine oil. There is an ever increasing drive in the combustion engine industry to increase the fuel efficiency of combustion engines. One approach to that objective is to reduce the viscosity of the engine oil. Yet, if the viscosity becomes too low the lubricating efficacy can diminish. An added challenge is that combustion engines operate over a broad range of temperature that can be well below zero degrees Celsius (° C.) on a cold winter day when starting to well over 100° C. on a hot summer day after running for several hours. Engine oil typically changes viscosity based on temperature during its use. The extent to which engine oil changes its viscosity over a change in temperature is the oil's Viscosity Index, which is derived from a calculation based on the kinematic viscosity of the engine oil at 40° C. and 100° C. Higher viscosity index values correspond to less change in viscosity over a temperature range. Lubricants having a high viscosity index are desirable so as to maintain a desirable viscosity over a broad temperature range. If the viscosity becomes too high, then fuel efficiency suffers. If the viscosity becomes too low, then lubricating capability decreases and excessive engine wear can occur.

Viscosity index improvers are additives for engine oils that tend to reduce the change in oil viscosity over a temperature range. Typical viscosity index improvers include, for example, polyalkylmethacrylates (such as polymethylmethacrylates) and olefin block copolymers. Unfortunately, while viscosity index improvers can increase an engine oil's viscosity index, they also tend to increase the engine oil viscosity at low temperature (−10° C.). Low temperature viscosity is important to consider when starting an engine in low temperature environments. While it is important for an engine oil to form a film that is viscous enough to prevent wear in order to protect engine components, it is also important that the engine oil not be so viscous so as to cause high frictional losses due to excessive viscous drag due to the oil.

Automotive lubricants contain a base oil that has a kinematic viscosity of 100 centiStokes (cSt) or less at 40 degrees Celsius (° C.) (an "automotive lubricant base oil") and can have kinematic viscosities as low as 20 cSt at 40° C. A low viscosity is necessary to accommodate the extensive array of additives that are typically included in an automotive lubricant formulation without becoming so viscous that they are not suitable for automotive lubricants. Automotive lubricants typically contain greater than ten weight percent additives (including co-base oils) to a base oil to accomplish objectives such as anti-oxidation, ferrous corrosion inhibition, yellow metal passivation, viscosity index increase, detergents, dispersants, antiwear, extreme pressure facilitation, pour point depression, friction modification and antifoaming.

It is desirable to identify a viscosity index improving additive for automotive lubricant base oils that also reduces the low temperature (−10° C.) kinematic viscosity of the base oil. Particularly valuable would be an additive that increases viscosity index of an automotive lubricant base oil by at least 10 points and/or increases viscosity index to a value of 130 or higher while still reducing the low temperature viscosity.

BRIEF SUMMARY OF THE INVENTION

The present invention provides a solution to the problem of providing an additive for automotive lubricant base oils that increases the viscosity index of the base oil while at the same time lowers the low temperature (−10° C.) kinematic viscosity of the base oil. Moreover, the present invention provides an additive for automotive base oils that increase the viscosity index the base oil by at least 10 points and/or increases viscosity index to a value of 130 or higher while still reducing the low temperature viscosity. Automotive lubricant base oils are characterized by having a kinematic viscosity of 100 cSt or less at 40° C. Changes to viscosity index and kinematic viscosity of the base oil herein refer to a comparison of those properties for the pure automotive base oil to a formulation of the automotive base oil with an alkyl capped oil soluble polymer (AC-OSP), the combination of which is an automotive base oil formulation.

The present invention is a result of surprisingly and unexpectedly discovering that AC-OSPs serve as both highly effective viscosity index improvers and as highly effective low temperature viscosity reducing agents for automotive lubricant base oils.

In a first aspect, the present invention is an automotive lubricant base oil formulation comprising a base oil, preferably a hydrocarbon base oil, having a kinematic viscosity of 100 centiStokes or less at 40 degrees Celsius and an AC-OSP where the AC-OSP has the structure of Formula I:

$$R^1[O(R^2O)_n(R^3O)_mR^4]_p \quad \text{(I)}$$

where $R^1$ is an alkyl having from one to thirty carbons, $R^2$ and $R^3$ are independently selected from alkyls having three or four carbons and can be in block form or randomly combined, $R^4$ is an alkyl having from one to 18 carbon atoms, n and m are independently numbers ranging from zero to 20 provided that n+m is greater than zero and p is a number within a range of one to three; wherein the automotive lubricant base oil formulation has a kinematic viscosity of 100 centiStokes or less at 40 degrees Celsius. The automotive lubricant base oil formulation can have a kinematic viscosity at 40 degrees Celsius of 20 cSt or more, even 50 cSt or more and at the same time has a kinematic viscosity of 100 cSt or less and can have a kinematic viscosity of 50 cSt or less at 40 degrees Celsius.

In a second aspect, the present invention is a method for increasing the viscosity index of a base oil having a kinematic viscosity of 100 centiStokes or less at 40 degrees Celsius while simultaneously decreasing the viscosity of the base oil at a temperature of −10 degrees Celsius, the method comprising blending into the base oil an AC-OSP where the AC-OSP has the structure of Formula I:

$$R^1[O(R^2O)_n(R^3O)_mR^4]_p \quad (I)$$

where $R^1$ is an alkyl having from one to thirty carbons, $R^2$ and $R^3$ are independently selected from alkyls having three or four carbons, $R^4$ is an alkyl having from one to 18, n and m are independently selected from one and numbers ranging from one to 20 provided that n+m is greater than zero and p is a number within a range of one to three so as to achieve the automotive lubricant base oil formulation of the first aspect.

In a third aspect, the present invention is a method for lubricating an automotive mechanical device that comprises multiple parts that move with respect to one another, the method comprising introducing a lubricant comprising the base oil formulation of the first aspect into the mechanical device so that the lubricant accesses interstices between the parts that move with respect to one another.

The base oil formulation of the present invention is useful to prepare an automotive lubricant, such as is useful for lubricating a mechanical device such as an internal combustion engine or a transmission system.

DETAILED DESCRIPTION OF THE INVENTION

"And/or" means "and, or alternatively", ranges include endpoints unless otherwise stated.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institut für Normung; and ISO refers to International Organization for Standards.

Determine kinematic viscosity according to ASTM D7042. Determine viscosity index for a base oil formulation according to ASTM D2270.

"Automotive base oil" and "automotive lubricant base oil" are interchangeable terms and refer to a base oil having a kinematic viscosity (KV) of 100 centiStokes (cSt) or less at 40 degrees Celsius (° C.). The automotive base oil generally also has a KV of 20 cSt or more at 40° C. Desirably, the automotive base oil has a KV of 10 cSt or less, preferably 8 cSt or less, more preferably 6 cSt or less at 100° C. Preferably, the base oil is a polyalphaolefin.

Automotive base oils can be or comprise any one or combination of more than one base oil from the American Petroleum Institute (API) classifications of Group I, Group II, Group III, Group IV and Group V base oils. Group I-III base oils are considered hydrocarbon base oils, Group IV base oils are synthetic base oils that are polyalphaolefins and Group V base oils are considered other synthetic base oils. The automotive base oil of the present invention can be a hydrocarbon base oil, a synthetic base oil or a combination thereof. Group I base oils are composed of fractionally distilled petroleum which is further refined with solvent extraction processes to improve properties such as oxidation resistance and to remove wax. The viscosity index of Group I base oils is between 80 and 120. Group I base oils have a sulphur content of more than 0.03 weight percent (wt %). Group II base oils are composed of fractionally distilled petroleum that has been hydrocracked to further refine and purify it. Group II base oils also have a viscosity index between 80 and 120, but a sulphur content of less than 0.03 wt %. Group III base oils have similar characteristics to Group II base oils but have a viscosity index above 120 with a sulphur content less than 0.03 wt %. Group II base oils are highly hydro-processed oils and Group III base oils are highly hydro-cracked oils. Group III base oils have a higher viscosity index than Group II base oils, and are prepared by either further hydro-cracking of Group II base oils, or by hydro-cracking of hydro-isomerized slack wax, which is a byproduct of the dewaxing process used for many of the oils in general. Group IV base oils are synthetic hydrocarbon oils, which are also referred to as polyalphaolefins (PAOs). Group V base oils are other synthetic base oils such as synthetic esters, polyalkylene glycols, polyisobutylenes, and phosphate esters.

The automotive base oil formulation of the present invention comprises an automotive base oil and an alkyl capped oil soluble polymer (AC-OSP) having a structure as shown in Formula I:

$$R^1[O(R^2O)_n(R^3O)_mR^4]_p \quad (I)$$

$R^1$ is an alkyl having from one or more, preferably four or more, still more preferably six or more and can have eight or more, ten or more even twelve or more carbons while at the same time has thirty carbons or fewer, preferably 26 carbons or fewer and more preferably 24 carbons or fewer, and can have 20 carbons or fewer, 18 carbons or fewer, 16 carbons or fewer, 14 carbons or fewer or even 12 carbons or fewer. $R^2$ and $R^3$ are independently selected from alkyls having three or four carbons and can be the same or different. $R^4$ is an alkyl having from one or more and can have two or more and typically has 18 or fewer carbons. Subscripts n and m are independently (meaning they do not have to be the same) numbers ranging from zero to 20 provided that n+m is greater than zero. Subscript p is a number that is one or more and can be two or more and is typically three or lower. Preferably, p has a value of one, which would be the case when $R^1$ is the residual of a monol initiator used to prepare the AC-OSP during the polymerization of the alkylene oxides. For individual AC-OSP molecules, n, m and p are integer values yet for multiple molecules one or ordinary skill understands that the collection of molecules can have an average value for n, m and/or p that is not an integer. The average value of m, n and p for the AC-OSP molecules of the invention fall within the specified range.

The AC-OSP is selected from a group of 1,2-propylene oxide polymers, 1,2-butylene oxide polymer, random copolymers of 1,2-propylene oxide and 1,2-butylene oxide and block copolymers of 1,2-propylene oxide and 1,2-butylene oxide. For 1,2-propylene oxide and 1,2-butylene oxide copolymers the $OR^2$ and $O^3$ components can be in block form with all $OR^2$ units occurring together in sequence and all $OR^3$ units occurring together in sequence or the copolymer can be random with $OR^2$ and $OR^3$ elements occurring in random order.

Desirably, the AC-OSP has a molecular weight selected so that the kinematic viscosity of the inventive automotive lubricant base oil formulation is less than six (cSt) at 100° C. Increasing molecular weight of the AC-OSP generally increases the resulting kinematic viscosity of the automotive lubricant base oil formulation. Therefore, one of ordinary skill can readily elect lower molecular weight AC-OSPs to reduce the kinematic viscosity of an automotive lubricant base oil formulation of the present invention in order to achieve a kinematic viscosity of less than six cSt at 100° C. if desired. The AC-OSP also desirably has a viscosity index in neat form of 150 or more.

Generally, the AC-OSP has a molecular weight of 200 grams per mole (g/mol) and can have a molecular weight of 300 g/mol or more, 400 g/mole or more, 500 g/mol or more and even 600 g/mol or more while at the same time generally has a molecular weight of 700 g/mol or less and can have a molecular weight of 600 g/mol or less. Calculate the molecular weight for an AC-OSP from the molecular weight of the non-capped OSP and the molecular weight of the cap. Determine molecular weight in grams per mole (g/mol) for the non-capped OSP from the hydroxyl number. Determine hydroxyl number and molecular weight according to ASTM D4274. The molecular weight of the AC-OSP is then the molecular eight of the capping group plus the molecular weight of the non-capped OSP minus one. For example, capping an OSP with a methyl group would produce a capped OSP having a molecular weight equal to 15 g/mol for the methyl group, plus the molecular weight of the non-capped OSP, minus one g/mol due to loss of a hydrogen from the OSP upon replacement of the hydrogen with the capping group.

Generally, the automotive lubricant base oil formulation of the present invention comprises five weight-percent (wt %) or more, preferably ten wt % or more and can comprise 15 wt % or more, 20 wt % or more, 25 wt % or more 30 wt % or more 35 wt % or more, 40 wt % or more, or even 45 wt % or more while at the same time generally comprises 50 wt % or less, preferably 45 wt % or less and can comprise 40 wt % or less, 45 wt % or less, 40 wt % or less, 35 wt % or less, 30 wt % or less, 25 wt % or less, 20 wt % or less, 15 wt % or less or even 10 wt % or less AC-OSP based on the combined weight of hydrocarbon base oil and AC-OSP.

The automotive lubricant base oil formulation can have a kinematic viscosity at 40 degrees Celsius of 20 cSt or more, even 50 cSt or more and at the same time has a kinematic viscosity of 100 cSt or less and can have a kinematic viscosity of 50 cSt or less at 40 degrees Celsius.

The automotive lubricant base oil formulation of the present invention can be further formulated with additional additives in combination with the automotive base oil and AC-OSP to form an automotive lubricant. Suitable additional components include additives commonly used in lubricant formulations. Examples of suitable additional components include any one or combination of more than one selected from a group consisting of antioxidants, corrosion inhibitors, anti-wear additive, foam control agents, yellow metal passivators, dispersants, detergents, extreme pressure additives, friction reducing agents, pour point depressants and dyes. Additional additives are desirably soluble in the hydrocarbon base oil. An automotive lubricant formulation typically contains more than ten wt % total additives (including co-base oils such as the AC-OSP) based on total automotive lubricant weight.

The present invention includes a method for increasing the viscosity index of an automotive base oil while simultaneously decreasing the viscosity of the automotive base oil at a temperature of −10° C. The method comprises blending the AC-OSP with the automotive base oil to obtain the automotive base oil formulation of the present invention. The present invention surprisingly demonstrates that AC-OSPs as described above can achieve the desirable result of increasing the viscosity index of the automotive base oil while at the same time decreasing the viscosity of the automotive base oil at a temperature of −10° C. In fact, the AC-OSPs are capable of increasing the viscosity index of the automotive base oil by 10 points or more and/or to a value of 130 or more. As the comparative examples below herein reveal, AC-OSPs that lack the alkyl capping do not have this same efficacy on hydrocarbon base oils.

The present invention also includes a method for lubricating an automotive mechanical device such as an automotive engine (for example, an internal combustion engine) or transmission by introducing a lubricant comprising the base oil formulation of the present invention into the automotive mechanical device comprising parts that move with respect to one another so that the lubricant accesses interstices between the parts that move with respect to one another.

The automotive base oil formulation of the present invention offers the surprising advantage over other automotive base oils in that it has a higher viscosity index and a lower viscosity at a temperature of −10 C than the automotive base oil of the automotive base oil formulation and can increase the viscosity index by at least 10 points and/or to a value of at least 130.

EXAMPLES

Oil Soluble Polymer A (OSP-A)

Load 887 grams (g) of 2-ethyl-1-hexanol initiator into a stainless steel reactor vessel followed by 5.3 g of 85 wt % aqueous potassium hydroxide and heat the mixture to 115° C. under a nitrogen blanket. Feed into the reactor vessel 1057.5 g of 1,2-propylene oxide and 1057.5 g 1,2-butylene oxide at a temperature of 130° C. and a pressure of 430 kiloPascals (kPa). Stir the mixture and allow it to digest for 23 hours at 130° C. Remove residual catalyst by filtration through a magnesium silicate filtration bed at a temperature of 50° C. to yield a product (OSP-A) having a kinematic viscosity at 40° C. of 13.5 cSt, kinematic viscosity at 100° C. of 3.1 cSt and a pour point of −62.0° C.

Methyl Capped OSP-A (OSP-AC)

Load 1600 g of 2-ethyl-1-hexanol into a stainless steel reactor vessel followed by 11.3 g of 85 wt % aqueous potassium hydroxide and heat the mixture to 115° C. under a nitrogen blanket. Add a mixture of 2400 g 1,2-propylene oxide and 240 g 1,2-butylene oxide into the reactor at a temperature of 130° C. and a pressure of 500 kPa. Stir the mixture and allow it to digest for 12 hours at 130° C. Remove residual catalyst by filtration through a magnesium silicate filtration bed at a temperature of 50° C. to yield an intermediate similar to OSP-A and having a kinematic viscosity at 40° C. of 17.7 cSt, kinematic viscosity at 100° C. of 3.81 cSt and a pour point of −59.0° C.

Load 5805 g of the intermediate into a stainless steel reactor vessel. Add 2604 g sodium methoxide solution (25 wt % sodium methoxide in methanol) and stir the mixture at 120° C. for 12 hours under a vacuum (below 45 kPa absolute pressure) with a nitrogen purge of 200 milliliters per minute and a stirring speed of 180 revolutions per minute. Feed 639 g of methyl chloride into the reactor at a temperature of 80° C. and a pressure of 170 kPa. Stir the mixture and allow to digest for one hour at 80° C. After the mixture digests, flash for 20 minutes at 80° C. and remove unreacted methyl chloride and dimethyl ether using a vacuum. Add 2133 g water and stir for one hour at 80° C. to wash the sodium chloride from the mixture. Stop the stirrer and allow to settle for 1.5 hours at 100° C. under vacuum and a pressure of less than one kPa with a nitrogen purge of 200 milliliters per minute and a stirrer speed of 180 revolutions per minute. Cool the resulting product to 60° C. and filter through a magnesium silicate filtration bed at 50° C. to yield a product (OSP-AC) that has a capping conversion of 98.9%, kinematic viscosity at 40° C. of 10.3 cSt, kinematic viscosity at 100° C. of 3.1 cSt, a viscosity index of 173 and a pour point of −74.0° C. OSP-AC is essentially a methyl capped form of OSP-A. Slight differences in the pre-capped material are by design so that the final capped product has a similar kinematic viscosity at 100° C. to OSP-A.

Oil Soluble Polymer B (OSP-B)

Load 4364 g of dodecanol initiator into a stainless steel reactor vessel followed by 39.68 g of 45 wt % aqueous potassium hydroxide and heat the mixture to 115° C. under a nitrogen blanket. Flash the mixture to remove water at 115° C. and three mega Pascals pressure until the water concentration is below 0.1 wt %. Feed a mixture of 2276 g 1,2-propylene oxide and 2276 g 1,2-butylene oxide into the reactor at a temperature of 130° C. and pressure of 370 kPa. Stir the mixture and allow it to digest for 12 hours at 130° C. Remove residual catalyst by filtration through a magnesium silicate filtration bed at 50° C. to yield a product (OSP-B) having a kinematic viscosity at 40° C. of 12.2 cSt, kinematic viscosity at 100° C. of 3.0 cSt and a pour point of −29.0° C.

Methyl Capped OSP-B (OSP-BC)

Load 2369 g of dodecanol initiator into a stainless steel reactor vessel followed by 20.02 g of 45 wt % aqueous potassium hydroxide and heat the mixture to 115° C. under a nitrogen blanket. Flash the mixture to remove water at 115° C. and three mega Pascals pressure until the water concentration is below 0.1 wt %. Feed a mixture of 1808.5 g 1,2-propylene oxide and 1808.5 g 1,2-butylene oxide into the reactor at a temperature of 130° C. and pressure of 490 kPa. Stir the mixture and allow it to digest for 14 hours at 130° C. Remove residual catalyst by filtration through a magnesium silicate filtration bed at 50° C. to yield a product (Intermediate B) having a kinematic viscosity at 40° C. of 16.1 cSt, kinematic viscosity at 100° C. of 3.7 cSt, a viscosity index of 183 and a pour point of −39.0° C.

Load 5797 g of Intermediate B into a stainless steel reactor vessel. Add 2765 g of sodium methoxide solution (25 wt % in methanol) and stir at 120° C. for 12 hours at 80° C. under vacuum (less than one kPa) with nitrogen purging at 200 milliliters per minute and a stirring speed of 180 revolutions per minute. Discharge 3825 g of the mixture from the reactor. To the remaining 2264 g of mixture feed 252 g of methyl chloride at a temperature of 80° C. at a pressure of 260 kPa. Stir the mixture and allow it to digest for 1.5 hours at 80° C. After digesting the mixture, flash for 10 minutes at 80° C. under vacuum to remove unreacted methyl chloride and dimethyl ether. Add 796 g of water and stir for 40 minutes at 80 C. to wash the sodium chloride from the mixture. Stop stirring and allow to settle for one hour at 80° C. Decant off 961 g of brine phase. Add 50 g of magnesium silicate to the remaining mixture and flash off residual water in one hour at 100° C. under vacuum (less than one kPa pressure) with nitrogen purging at 200 milliliters per minute and stirring rate of 180 revolutions per minute. Cool the resulting material to 60° C. and discharge 2218 grams and filter it through a magnesium silicate filtration bed at 50° C. to yield a product (OSP-BC) that has a capping conversion of 93.7%, kinematic viscosity at 40° C. of 9.9 cSt, kinematic viscosity at 100° C. of 3.0 cSt and a pour point of −45.0° C. OSP-BC is essentially a methyl capped form of OSP-B. Slight differences in the pre-capped material are by design so that the final capped product has a similar kinematic viscosity at 100° C. to OSP-A.

Automotive Base Oils

The automotive base oils used in the following examples described in Table 1:

TABLE 1

| Base Oil | Description |
|---|---|
| Group I | Type I hydrocarbon base oil (mineral oil with kinematic viscosity at 100° C. of 5.0 cSt, commercially available as Total 150 S.N. from Total) |
| Group III | Type III hydrocarbon base oil (mineral oil with a typical kinematic viscosity at 100° C. of four cSt, commercially available as Nexbase ™ 3043 from Neste; Nexbase is a trademark of Neste Oil OYJ Corporation, Finland) |
| PAO-4 | Type IV hydrocarbon base oil (polyalphaolefin base oil with a typical kinematic viscosity at 100° C. of 4 cSt, commercially available as Synfluid ™ PAO-4 from Chevron Phillips Chemical, Synfluid is a trademark of Chevron Phillips Chemical Company LP) |

Automotive Base Oil Formulations

Prepare automotive base oil formulation using the three different automotive base oils in Table 1 and the four different oil soluble polymers (OSPs) described above at OSP loadings ranging from five to 50 wt % based on combined weight of OSP and base oil. Determine kinematic viscosities and viscosity index (VI) values for the lubricant formulations. Tables 2-4 contain the results. For Tables 2-4, "KV" refers to "kinematic viscosity" in units of cSt.

Notably, results for automotive base oil formulations using a Group II base oil are expected to perform similarly to lubricant formulations using Group I and Group III base oils due the fact Group II base oils have properties intermediate between Group I and Group III base oils. So, while no results are shown for Group II base oil formulations, the results are expected to be similar to those shown below for the Group I and Group III base Oil formulations.

TABLE 2

Group I Hydrocarbon Base Oil and Formulations

| | | | Weight-Percent OSP | | | | | |
|---|---|---|---|---|---|---|---|---|
| Sample | OSP | Property | 0 | 5 | 10 | 20 | 30 | 50 |
| Comp Ex A | OSP-A | KV @ 40° C. | 28.1 | 23.2 | 24.6 | 24.5 | 19.7 | 16.0 |
| | | KV@100° C. | 5.0 | 4.69 | 4.61 | 4.57 | 3.99 | 3.49 |
| | | VI | 103 | 93 | 101 | 99 | 96 | 92 |
| | | KV@−10° C. | 570 | 593 | 537 | 481 | 362 | 232 |

TABLE 2-continued

| Group I Hydrocarbon Base Oil and Formulations | | | | | | | | |
|---|---|---|---|---|---|---|---|---|
| | | | Weight-Percent OSP | | | | | |
| Sample | OSP | Property | 0 | 5 | 10 | 20 | 30 | 50 |
| Ex 1 | OSP-AC | KV @ 40° C. | (see Comp | 26.1 | 24.1 | 21.4 | 18.8 | 14.8 |
| | | KV@100° C. | Ex A) | 4.83 | 4.63 | 4.37 | 4.10 | 3.70 |
| | | VI | | 106 | 108 | 113 | 120 | 142 |
| | | KV@−10° C. | | 504 | 437 | 305 | 259 | 173 |
| Comp Ex B | OSP-B | KV @ 40° C. | see Comp | 23.6 | 23.2 | 21.3 | 18.1 | 15.3 |
| | | KV@100° C. | Ex A) | 4.56 | 4.51 | 4.26 | 3.87 | 3.45 |
| | | VI | | 107 | 107 | 108 | 109 | 100 |
| | | KV@−10° C. | | 513 | 434 | 351 | 325 | 251 |
| Ex 2 | OSP-BC | KV @ 40° C. | (see Comp | 25.8 | 24.0 | 20.6 | 18.0 | 14.2 |
| | | KV@100° C. | Ex A) | 4.80 | 4.75 | 4.34 | 4.07 | 3.55 |
| | | VI | | 106 | 118 | 120 | 128 | 135 |
| | | KV@−10° C. | | 509 | 458 | 328 | 260 | 137 |

TABLE 3

| Group III Hydrocarbon Base Oil and Formulations | | | | | | | | |
|---|---|---|---|---|---|---|---|---|
| | | | Weight-Percent OSP | | | | | |
| Sample | OSP | Property | 0 | 5 | 10 | 20 | 30 | 50 |
| Comp Ex C | OSP-A | KV @ 40° C. | 19.0 | 18.9 | 17.3 | 16.5 | 15.1 | 14.2 |
| | | KV@100° C. | 4.16 | 4.17 | 3.96 | 3.79 | 3.53 | 3.35 |
| | | VI | 123 | 125 | 127 | 121 | 114 | 107 |
| | | KV@−10° C. | 286 | 270 | 250 | 240 | 203 | 215 |
| Ex 3 | OSP-AC | KV @ 40° C. | (see Comp | 17.8 | 17.8 | 16.0 | 14.7 | 13.0 |
| | | KV@100° C. | Ex C) | 4.0 | 4.07 | 3.8 | 3.65 | 3.44 |
| | | VI | | 124 | 131 | 131 | 137 | 148 |
| | | KV@−10° C. | | 265 | 245 | 207 | 168 | 136 |
| Comp Ex D | OSP-B | KV @ 40° C. | see Comp | 18.5 | 16.3 | 16.0 | 14.4 | 13.0 |
| | | KV@100° C. | Ex C) | 4.13 | 3.77 | 3.76 | 3.43 | 3.20 |
| | | VI | | 127 | 126 | 126 | 116 | 111 |
| | | KV@−10° C. | | 258 | 205 | 206 | 199 | 151 |
| Ex 4 | OSP-BC | KV @ 40° C. | (see Comp | 18.5 | 16.7 | 15.9 | 14.9 | 12.4 |
| | | KV@100° C. | Ex C) | 4.15 | 3.86 | 3.76 | 3.67 | 3.32 |
| | | VI | | 129 | 126 | 128 | 136 | 145 |
| | | KV@−10° C. | | 237 | 171 | 145 | 165 | 131 |

TABLE 4

| Group IV Hydrocarbon Base Oil and Formulations | | | | | | | | |
|---|---|---|---|---|---|---|---|---|
| | | | Weight-Percent OSP | | | | | |
| Sample | OSP | Property | 0 | 5 | 10 | 20 | 30 | 50 |
| Comp Ex E | OSP-A | KV @ 40° C. | 16.8 | 16.3 | 15.3 | 14.7 | 14.1 | 13.6 |
| | | KV@100° C. | 3.87 | 3.81 | 3.65 | 3.54 | 3.39 | 3.23 |
| | | VI | 125 | 127 | 126 | 123 | 114 | 102 |
| | | KV@−10° C. | 191 | 180 | 190 | 165 | 180 | 177 |
| Ex 5 | OSP-AC | KV @ 40° C. | (see Comp | 15.8 | n/d* | 15.2 | 13.6 | 12.2 |
| | | KV@100° C. | Ex E) | 3.76 | n/d* | 3.68 | 3.46 | 3.28 |
| | | VI | | 130 | n/d* | 131 | 136 | 144 |
| | | KV@−10° C. | | 165 | n/d* | 164 | 147 | 109 |
| Comp Ex F | OSP-B | KV @ 40° C. | see Comp | 16.0 | 15.1 | 14.5 | 14.0 | 13.0 |
| | | KV@100° C. | Ex E) | 3.78 | 3.62 | 3.50 | 3.43 | 3.17 |
| | | VI | | 129 | 125 | 121 | 115 | 107 |
| | | KV@−10° C. | | 162 | 159 | 156 | 150 | 146 |
| Ex 6 | OSP-BC | KV @ 40° C. | (see Comp | 16.1 | 15.6 | 14.0 | 13.9 | 12.1 |
| | | KV@100° C. | Ex E) | 3.81 | 3.76 | 3.63 | 3.54 | 3.36 |
| | | VI | | 130 | 134 | 135 | 140 | 161 |
| | | KV@−10° C. | | 177 | 137 | 152 | 130 | 110 |

*n/d means "not determined".

The data in Tables 2-4 reveal that adding an AC-OSP to an automotive base oil both increases viscosity index and decreases kinematic viscosity at −10° C. of the resulting automotive base oil formulation relative to the pure automotive base oil. Moreover, the increase in viscosity index often results in a 10 point increase in viscosity index over the hydrocarbon base oil and/or a viscosity index value in excess of 130.

Effect of Common Viscosity Index Improvers

Common practice in-modifying the viscosity index of an automotive base oil is to add a viscosity index improver to the base oil in order to increase the viscosity index. However, unlike the formulations of the present invention, common viscosity index improvers also tend to cause an increase in low temperature (−10° C.) kinematic viscosity of the resulting base oil formulation. Table 5 shows results for lubricant formulations formulated using two different common viscosity index improvers to illustrate the effect they have on both viscosity index and low temperature kinematic viscosity of hydrocarbon base oil. Results for these two materials are expected to be typical for common viscosity index improvers. The two viscosity index improvers are:

VII-A, a viscous concentrate of polyalkylmethacrylate in a biodegradable carrier oil, the concentration having a kinematic viscosity at 100° C. of 1218 cSt and a flash point (ASTM D3278) of 140° C.; commercially available under the tradename Viscoplex™ 10-930, Viscoplex is a trademark of Evonik Rohmax Additives GMBH LLC); and VII-B, a solution of polyalkylmethacrylate in mineral oil with a kinematic viscosity at 100° C. of 500 cSt and a flash point (ASTM D3278) of 120° C.; commercially available under the tradename Viscoplex™ 6-054. The polyaklymethacrylate is a copolymer derived from methylmethacrylate and an alkylmethylmethacrylate in which the alkylmethacrylate fraction contains C12-C18 methacrylates. The number average molecular weight (Mn) of the polyalkylmethacrylate, as determined by gel phase chromatography, is approximately 37,000 grams per mole.

The Group III base oil used to collect the data of Table 5 has a kinematic viscosity at 100° C. of six cSt (Nexbase™ 3060 from Neste).

The data in Table 5 reveals that while common viscosity index improvers increase the viscosity index of a hydrocarbon base oil, they also tend to increase the kinematic viscosity of the formulation at −10° C.

What is claimed is:

1. An automotive lubricant base oil formulation comprising a hydrocarbon base oil having a kinematic viscosity of 100 cSt or less at 40° C. and 5 weight-percent (wt %) to 45 wt % of an alkyl capped oil soluble polymer, based on the total combined weight of the alkyl capped oil soluble polymer and the based oil, where the alkyl capped oil soluble polymer has the structure of Formula I:

$$R^1[O(R^2O)_n(R^3O)_mR^4]_p \quad (I)$$

where $R^1$ is an alkyl having from 1 to 30 carbons, $R^2$ and $R^3$ are different alkyls having 3 or 4 carbons and can be in block form or randomly combined, $R^4$ is a methyl group, n and m are independently numbers ranging from 1 to 20, and p is a number within a range of 1 to 3, and has a molecular weight of from 474 g/mol to less than 506 g/mol, wherein the automotive lubricant base oil formulation has a higher viscosity index and a lower kinematic viscosity at −10° C. relative to a second automotive lubricant base oil formation corresponding to the automotive lubricant base oil formulation, but in which the oil soluble polymer is not alkyl capped, and wherein the automotive lubricant base oil formulation exhibits a viscosity index less than or equal to 140.

2. The automotive lubricant base oil formulation of claim 1, wherein the hydrocarbon base oil is a polyalphaolefin.

3. The automotive lubricant base oil formulation of claim 1, wherein the alkyl capped oil soluble polymer is a random copolymer of 1,2-butylene oxide and 1,2-propylene oxide.

4. The automotive lubricant base oil formulation of claim 1, further characterized by p being 1.

5. The automotive lubricant base oil formulation of claim 1, further characterized by $R^1$ being an alkyl having from 8 to 12 carbons.

6. A method for increasing the viscosity index of a hydrocarbon base oil having a kinematic viscosity of 100 cSt or less at 40° C. while simultaneously decreasing the viscosity of the hydrocarbon base oil at a temperature of −10° C., the method comprising blending into the hydrocarbon base oil an alkyl capped oil soluble polymer where the alkyl capped oil soluble polymer has the structure of Formula I:

$$R^1[O(R^2O)_n(R^3O)_mR^4]_p \quad (I)$$

where $R^1$ is an alkyl having from 1 to 30 carbons, $R^2$ and $R^3$ are different alkyls having 3 or 4 carbons and can be in block form or randomly combined, $R^4$ is a methyl group, n and m are independent numbers ranging from 1 to 20 and p is a

TABLE 5

Group IV Hydrocarbon Base Oil and Formulations

| | Viscosity Index | | Group I Base Oil Weight-Percent Viscosity Index Improver | | | Group III Base Oil Weight-Percent Viscosity Index Improver | | | Group IV Base Oil Weight-Percent Viscosity Index Improver | | |
|---|---|---|---|---|---|---|---|---|---|---|---|
| Sample | Improver | Property | 0 | 5 | 10 | 0 | 5 | 10 | 0 | 5 | 10 |
| Comp Ex F | VII-A | KV @ 40° C. | 28.1 | 43.9 | 68.5 | 31.2 | 43.1 | 61.2 | 16.8 | 21.4 | 30.5 |
| | | KV@100° C. | 5.0 | 8.3 | 13.1 | 5.7 | 8.7 | 12.7 | 3.87 | 5.3 | 8.6 |
| | | VI | 103 | 169 | 196 | 127 | 187 | 209 | 125 | 200 | 280 |
| | | KV@−10° C. | 570 | 932 | 1286 | 556 | 629 | 906 | 190 | 188 | 339 |
| Comp Ex G | VII-B | KV @ 40° C. | (see | n/d* | n/d* | see | 42.2 | 56.3 | see | 24.0 | 31.5 |
| | | KV@100° C. | Comp | n/d* | n/d* | Comp | 8.1 | 10.4 | Comp | 5.5 | 7.5 |
| | | VI | Ex F) | n/d* | n/d* | Ex F) | 168 | 177 | Ex F) | 177 | 219 |
| | | KV@−10° C. | | n/d* | n/d* | | 805 | 936 | | 249 | 375 |

*n/d means "not determined"

number within a range of 1 to 3 so as to achieve the automotive lubricant base oil formulation of claim 1.

7. A method for lubricating an automotive mechanical device that comprises multiple parts that move with respect to one another, the method comprising introducing a lubricant comprising the base oil formulation of claim 1 into the mechanical device so that the lubricant accesses interstices between the parts that move with respect to one another.

8. The automotive lubricant base oil formulation of claim 1, wherein the automotive lubricant base oil formulation has a viscosity index that is at least 10 points higher than a corresponding viscosity index of the second automotive lubricant base oil formulation.

* * * * *